US009623446B2

(12) United States Patent
Iwamatsu et al.

(10) Patent No.: US 9,623,446 B2
(45) Date of Patent: Apr. 18, 2017

(54) SIEVING APPARATUS AND SIEVING METHOD

(71) Applicant: NARA MACHINERY CO., LTD., Tokyo (JP)

(72) Inventors: Hidetoshi Iwamatsu, Tokyo (JP); Yohei Kawaguchi, Tokyo (JP); Masato Shindo, Tokyo (JP)

(73) Assignee: NARA MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/063,611

(22) Filed: Mar. 8, 2016

(65) Prior Publication Data

US 2016/0184866 A1 Jun. 30, 2016

Related U.S. Application Data

(63) Continuation of application No. PCT/JP2014/005442, filed on Oct. 28, 2014.

(30) Foreign Application Priority Data

Oct. 30, 2013 (JP) ..... 2013-225407

(51) Int. Cl.
*B07B 13/00* (2006.01)
*B07B 1/12* (2006.01)
*B27K 9/00* (2006.01)

(52) U.S. Cl.
CPC ..... *B07B 13/003* (2013.01); *B07B 1/12* (2013.01); *B27K 9/002* (2013.01)

(58) Field of Classification Search
CPC ..... B07B 1/4645; B07B 1/4681; B07B 1/469; B07B 2201/04
See application file for complete search history.

(56) References Cited

U.S. PATENT DOCUMENTS 1,955,032 A * 4/1934 Stevenson, Jr. ..... B07B 1/282 209/397
3,595,488 A * 7/1971 Blakley ..... B02C 18/0092 241/21

(Continued)

FOREIGN PATENT DOCUMENTS

JP S55-35995 A 3/1980
JP S64-90074 A 4/1989

(Continued)

OTHER PUBLICATIONS

International Search Report issued in International Application No. PCT/JP2014/005442 mailed on Jan. 27, 2015 and translation thereof (7 pages).

(Continued)

*Primary Examiner* — Joseph C Rodriguez
(74) *Attorney, Agent, or Firm* — Nakanishi IP Associates, LLC

(57) ABSTRACT

A sieving apparatus includes first and second sieving portions. The first sieving portion includes a sieve with a plurality of elongated holes or slits for separation of an object to be sieved based on difference in cross-sectional diameter. The second sieving portion with a sieve constituted by a porous plate includes round holes for separation of the object that has passed through the elongated holes or slits based on difference in aspect ratio. The second sieving portion is employed after sieving by the first sieving portion. A diameter of the round holes in the porous plate constituting the sieve included in the second sieving portion is longer than an opening width in a shorter direction of the elongated hole or the slit of the sieve included in the first sieving portion.

11 Claims, 16 Drawing Sheets

(56) References Cited

U.S. PATENT DOCUMENTS

| | | | | |
|---|---|---|---|---|
| 4,181,603 | A | 1/1980 | Fox | |
| 4,254,878 | A * | 3/1981 | Marsh | B03B 9/06 209/288 |
| 5,222,605 | A * | 6/1993 | Pogue | B07B 1/38 209/239 |
| 5,873,973 | A * | 2/1999 | Koon | B29C 70/543 156/160 |
| 7,168,570 | B2 * | 1/2007 | Frejborg | B01D 29/33 209/283 |
| 8,267,255 | B2 * | 9/2012 | Kinuta | B07B 1/4618 209/397 |
| 8,517,180 | B2 * | 8/2013 | Raichle | B01J 8/0015 209/235 |
| 8,869,989 | B2 * | 10/2014 | Gallagher | D21D 5/026 162/55 |
| 2006/0243832 | A1 * | 11/2006 | McMinn | B07B 9/00 241/24.1 |
| 2011/0031169 | A1 * | 2/2011 | Folgner | B07B 1/282 209/234 |
| 2014/0061140 | A1 * | 3/2014 | Bailey | B07B 1/46 210/780 |

FOREIGN PATENT DOCUMENTS

| | | | |
|---|---|---|---|
| JP | H03-293069 | A | 12/1991 |
| JP | H04-307203 | | 10/1992 |
| JP | H05-185037 | A | 7/1993 |
| JP | H09-173981 | A | 7/1997 |
| JP | 2000-071209 | A | 3/2000 |
| JP | 2004-237139 | A | 8/2004 |
| JP | 2006-181414 | A | 7/2006 |
| JP | 2009-154108 | A | 7/2009 |
| JP | 2010-208306 | A | 9/2010 |
| JP | 2012-040701 | A | 3/2012 |
| JP | 2012-217899 | A | 11/2012 |

OTHER PUBLICATIONS

Written Opinion of the International Searching Authority issued in International Application No. PCT/JP2014/005442 mailed on Jan. 27, 2015 (5 pages).

* cited by examiner

SIEVING APPARATUS AND SIEVING METHOD

CROSS-REFERENCE TO RELATED APPLICATIONS

This application is a continuation application of International Patent Application No. PCT/JP2014/005442 filed on Oct. 28, 2014, which claims priority to Japanese Patent Application No. 2013-225407 filed Oct. 30, 2013, the entire contents of which are incorporated by reference.

TECHNICAL FIELD

The present invention relates to a sieving apparatus and a sieving method.

BACKGROUND ART

Conventionally, as in Patent Literature 1, an apparatus for separating spherical substances from non-spherical substances with use of vibration is proposed.

CITATION LIST

Patent Literature

Patent Literature 1: JP 05-185037 A

However, the apparatus in Patent Literature 1 separates granular materials based on the difference in friction coefficient of the granular materials. Although the apparatus may be able to separate spherical granular materials each having a low friction coefficient from non-spherical (indefinite in shape) granular materials each having a high friction coefficient the apparatus cannot separate granular materials based on the difference in cross-sectional diameter and aspect ratio.

SUMMARY OF INVENTION

One or more embodiments of the present invention provide a sieving apparatus and a sieving method enabling separation based on the difference in cross-sectional diameter and separation based on the difference in aspect ratio.

A sieving apparatus according to one or more embodiments of the present invention includes: a first sieving portion including a sieve provided, with a plurality of elongated holes or slits; and a second sieving portion used after sieving in the first sieving portion and provided with a sieve constituted by a porous plate, wherein a hole diameter of the porous plate constituting the sieve included in the second sieving portion is longer than an opening width of the elongated hole or the slit of the sieve included in the first sieving portion.

Sieving (separation) based on the difference in cross-sectional diameter can be performed at elongated holes (the elongated holes or slits) in the first sieving portion, and sieving (separation) based on the difference in aspect ratio can be performed at the porous plate of the second sieving portion.

Also, since the sieve included in the second sieving portion is constituted by the porous plate made by punching holes in a flat plate, a surface (an upper surface) mounting a raw material can be flatter than in a case in which the sieve included in the second sieving portion is constituted by a mesh made by weaving linear members such as wires in a lattice pattern. This can prevent elongated substances from being inclined by roughness of the surface mounting the raw material and easily passing through the holes of the sieve.

The sieve included in the first sieving portion may be constituted by a wedge wire screen.

The sieve included in the first sieving portion is constituted by a flat plate having oval holes.

The sieve included in the second sieving portion may be constituted by a flat plate having approximately circular holes.

The sieve included in the second sieving portion may have a longer dimension in thickness than a hole diameter of the approximately circular holes.

Since the sieve included in the second sieving portion has the longer thickness than the hole diameter, the elongated substances will not pass through the holes vertically unless the elongated substances enter the holes at end portions thereof in an erected state. Accordingly, the elongated substances are less likely to pass through the second sieving portion.

The sieve included in the second sieving portion may be constituted by a plurality of porous plates.

The higher the aspect ratio of a substance is, the less possible it is for the substance, even when the substance enters a hole of a first porous plate, to enter holes of second and subsequent porous plates. Consequently, this can significantly decrease the possibility that the substance passes through the second sieving portion.

A distance between the plurality of porous plates may be equal to or shorter than the hole diameter of the approximately circular holes.

A flat plate may be provided to be opposed to an upper surface of the sieve included in the second sieving portion or a lower surface of the sieve included in the second sieving portion.

The sieve included in the first sieving portion may be provided in a plurality of layers, and in the sieve included in the first sieving portion, an opening width of a sieve in a former layer (an upper layer) may be longer than an opening width of a sieve in a latter layer (a lower layer).

The sieve included in the second sieving portion may be provided in a plurality of layers, and in the sieve included in the second sieving portion, a hole diameter of a sieve in a former layer (an upper layer) may be longer than a hole diameter of a sieve in a latter layer (a lower layer).

The sieve included in the first sieving portion may include a first sieve and a second sieve arranged in a latter layer of the first sieve and having a shorter opening width than an opening width of an elongated hole or a slit of the first sieve, the sieve included in the second sieving portion may include a third sieve having a longer hole diameter than the opening width of the elongated hole or the slit of the first sieve and a fourth sieve whose hole diameter is shorter than the opening width of the elongated hole or the slit of the first sieve and longer than the opening width of an elongated hole or a slit of the second sieve, and among an object to be sieved, substances that have not passed through the second sieve may be subjected to sieving with use of the third sieve, and substances that have passed through the second sieve may be subjected to sieving with use of the fourth sieve.

With use of the first sieve and the second sieve, sieving of an input raw material can be performed based on the length of the cross-sectional diameter (separation based on the difference in cross-sectional diameter). With use of the third sieve, sieving of the raw material sieved in the second sieve and having a relatively long cross-sectional diameter (the raw material whose minimum cross-sectional diameter is shorter than the opening width of the first sieve and longer than the opening width of the second sieve) into elongated substances and approximately spherical substances (separation based on the difference in aspect ratio) can be performed. With use of the fourth sieve, sieving of the raw material sieved in the second sieve and having a relatively short cross-sectional diameter (the raw material whose minimum cross-sectional diameter is shorter than the opening width of the second sieve) into elongated substances and approximately spherical substances (separation based on the difference in aspect ratio) can be performed.

A sieving method according to one or more embodiments of the present invention includes: an upstream process for sieving an object to be sieved with use of a first sieving portion including a sieve provided with a plurality of elongated holes or slits; and a downstream process for sieving the object to be sieved that has been subjected to the upstream process with use of a second sieving portion provided with a sieve constituted by a porous plate, wherein a hole diameter of the porous plate constituting the sieve included in the second sieving portion is longer than an opening width of the elongated hole or the slit of the sieve included in the first sieving portion.

The sieve included in the first sieving portion may include a first sieve and a second sieve having a shorter opening width than an opening width of an elongated hole or a slit of the first sieve, the sieve included in the second sieving portion may include a third sieve having an equal or longer hole diameter to or than the opening width of the elongated hole or the slit of the first sieve and a fourth sieve whose hole diameter is shorter than the opening width of the elongated hole or the slit of the first sieve and longer than the opening width of an elongated hole or a slit of the second sieve, the upstream process may include a first sieving process for the object to be sieved with use of the first sieve and a second sieving process for the object to be sieved that has passed through the first sieve with use of the second sieve, and the downstream process may include a third sieving process for the object to be sieved that has not passed through the second sieve with use of the third sieve and a fourth sieving process for the object to be sieved that has passed through the second sieve with use of the fourth sieve.

The object to be sieved is bamboo subjected to a superheated steam treatment and thereafter ground, in the upstream process, separation of the bamboo based on difference in cross-sectional diameter may be performed, and in the downstream process, the bamboo may be separated into a bamboo fiber and a parenchyma cell.

As described above, according to one or more embodiments of the present invention, it is possible to provide a sieving apparatus and a sieving method enabling separation based on the difference in cross-sectional diameter and separation based on the difference in aspect ratio.

DESCRIPTION OF EMBODIMENTS

Hereinbelow, a first embodiment will be described, with reference to the drawings. A sieving apparatus 1 according to the first embodiment includes a first classification device 10*a* to a fourth classification device 10*d* (refer to FIGS. 1 to 8).

First, respective components of the first classification device 10*a* will be described.

The first classification device 10*a* includes a first inlet 11*a*, a first vibration applying unit 13*a*, a first trough 15*a*, a first sieve 30*a*, and a reprocessing container 36, and a first sieving process (a first upstream process) is performed with use of the first sieve 30*a*.

A raw material to be sieved in the first sieving process is input on the first sieve 30*a* via the first inlet 11*a* in a state in which the input amount thereof is adjusted.

The first vibration applying unit 13*a* is a unit, such as an electromagnetic feeder and a vibrating feeder, applying vibration in an approximately horizontal direction to a member attached to an upper portion thereof (the first trough 15*a* or the like).

Figure 1:
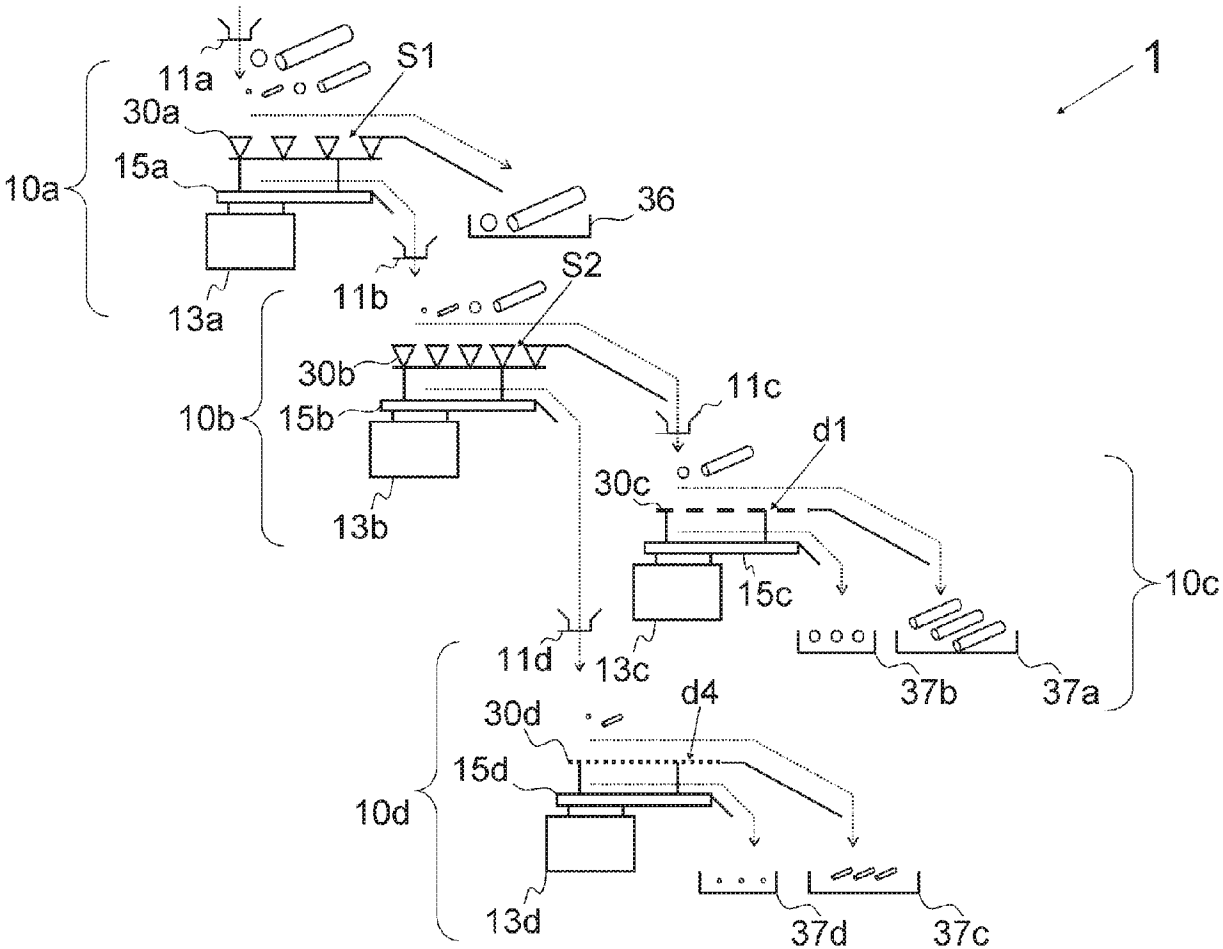
FIG. 1 is a schematic view illustrating a configuration of a sieving apparatus according to a first embodiment.
Figure 2:
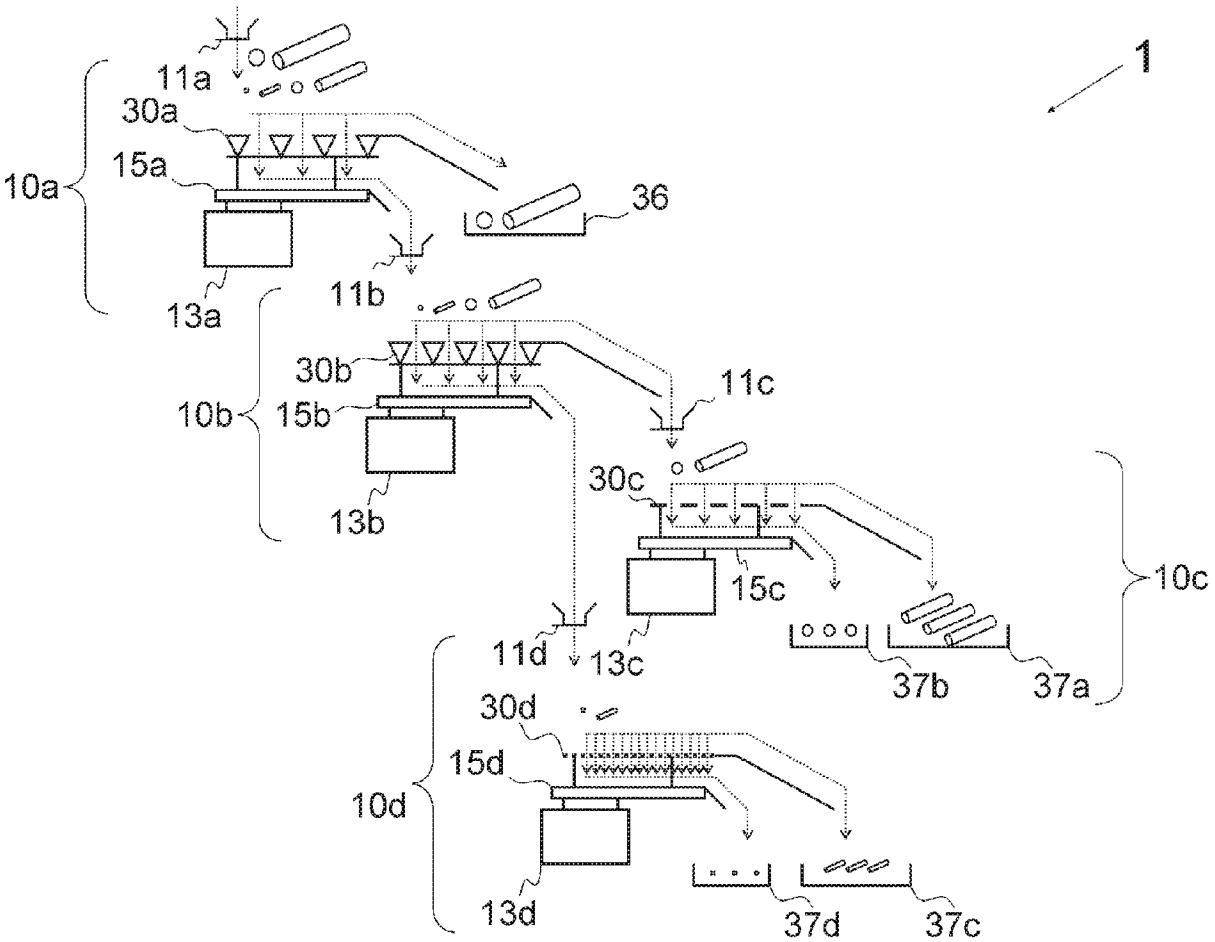
FIG. 2 is a schematic view illustrating the configuration of the sieving apparatus, particularly, a detail of passing through sieves.
Figure 3:
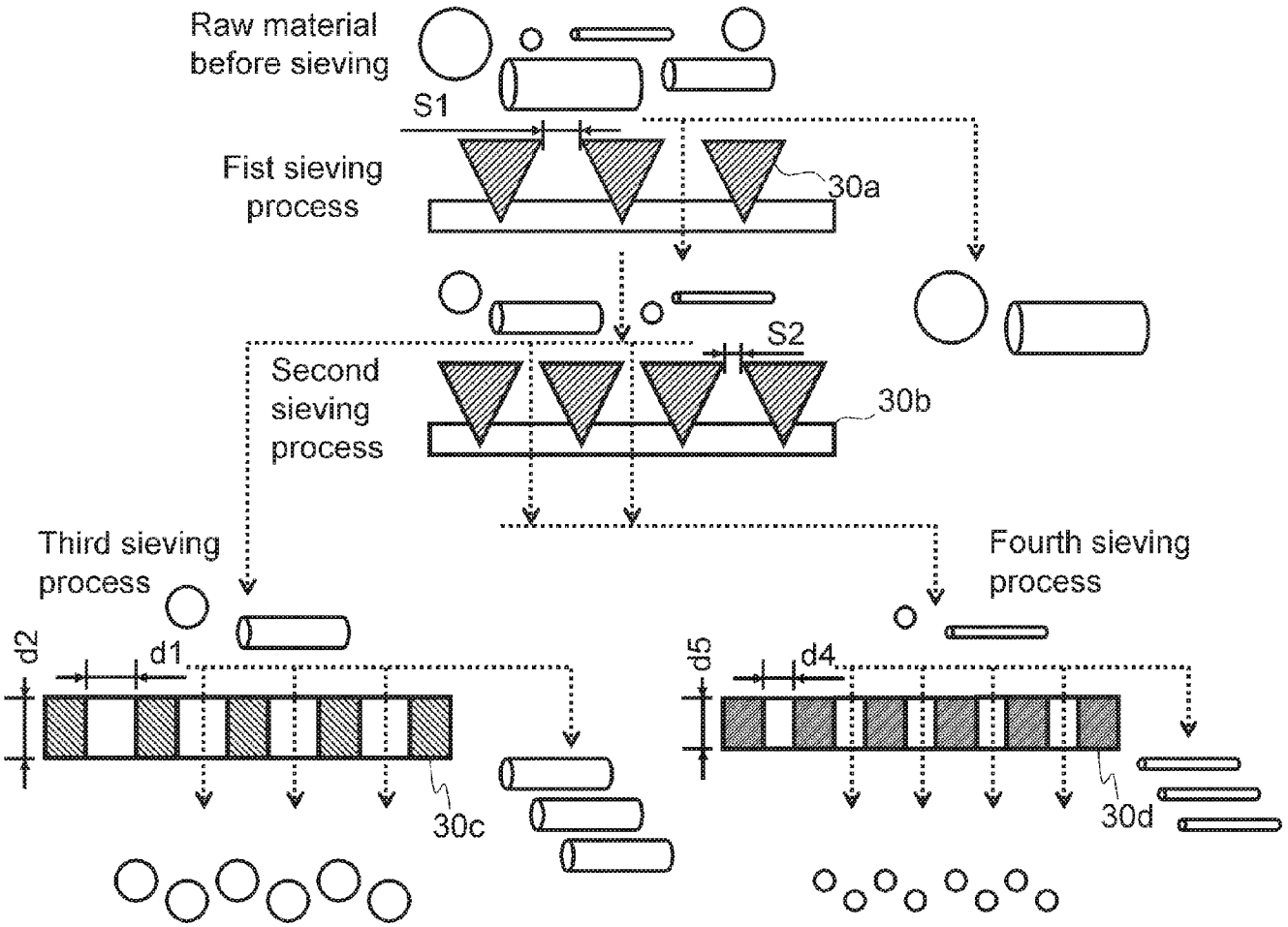
FIG. 3 is a schematic view illustrating configurations of a first sieve to a fourth sieve and flow of an object to be sieved.

The first trough 15*a* is attached to the upper portion of the first vibration applying unit 13*a*, and the first sieve 30*a* is attached to an upper portion of the first trough 15*a*. Meanwhile, the right sides (front end sides), as seen in FIGS. 1 and 2, of the first trough 15*a* and the first sieve 30*a* are inclined downward.

Figure 4:
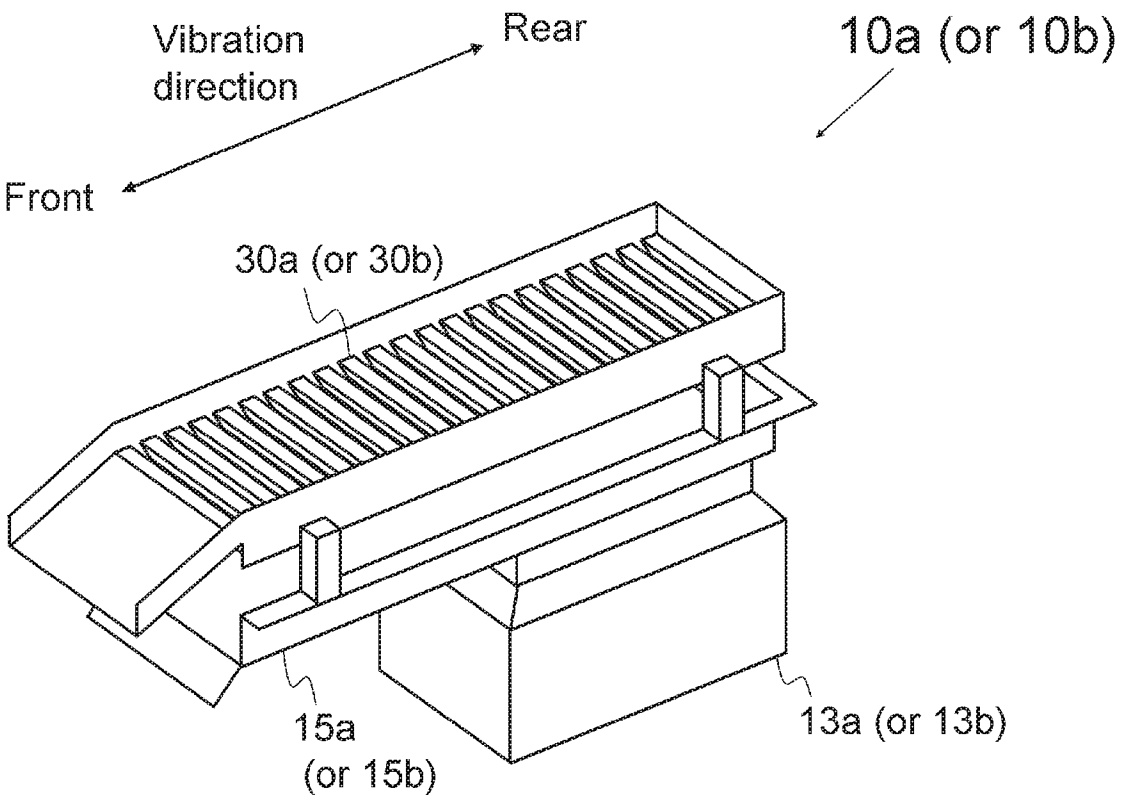
FIG. 4 is a perspective view illustrating a first classification device (or a second classification device)
Figure 5:
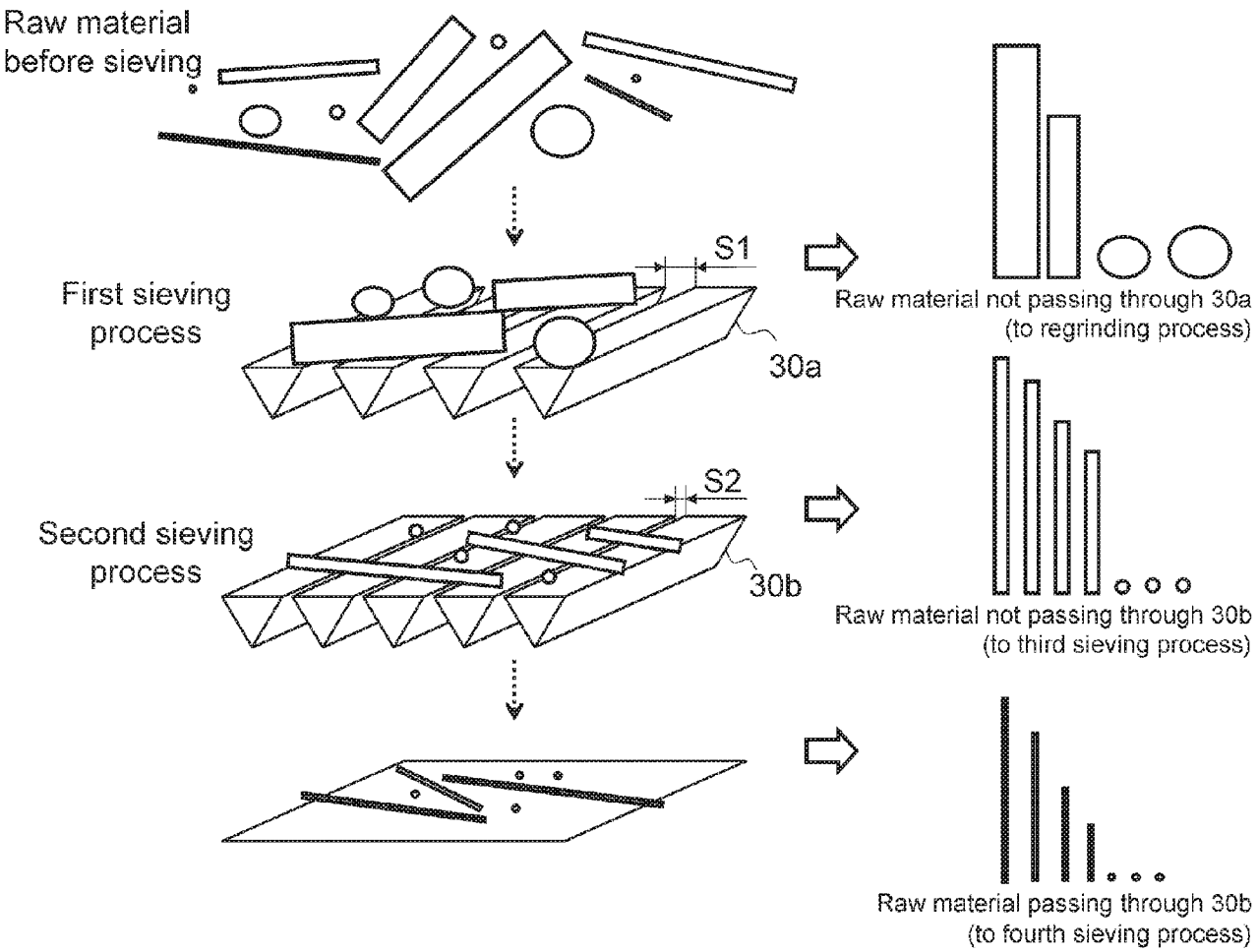
FIG. 5 is a schematic view illustrating the configurations of the first sieve and the second sieve and the flow of the object to be sieved.
Figure 6:
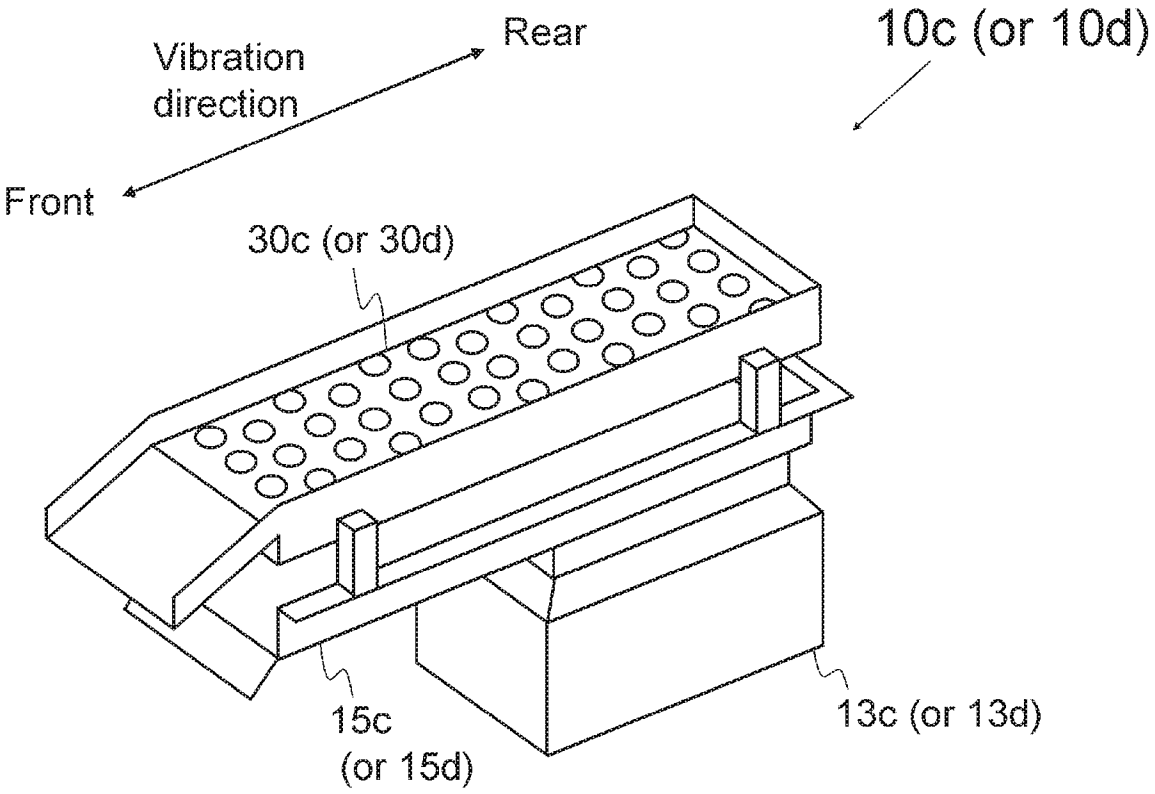
FIG. 6 is a perspective view illustrating a third classification device (or a fourth classification device).

Although it is preferable to provide side surfaces of the first trough 15*a* and the first sieve 30*a* with sidewalls to prevent the raw material from coming off of the side surfaces during movement, illustration of such sidewalls is omitted except in FIG. 4 to show structures of the side surfaces.

The first sieve 30*a* is constituted by a screen having slit-like holes each having a slit width of a first opening width S1 such as a wedge wire screen in which multiple wedge wires each made of a wedge-shaped metal wire having an approximately isosceles triangular cross-section are arranged in a state in which tops of the triangles face downward and in which slits each having a predetermined dimension are provided between the wedge wires.

The raw material input on the first sieve 30*a* moves forward on the first sieve 30*a* based on the vibration transmitted from the first vibration applying unit 13*a*.

In the raw material on the first sieve 30*a*, substances each having a shorter cross-sectional diameter than the first opening width S1 and substances each having a longer cross-sectional diameter than the first opening width S1 are mixed. Among these substances, the substances each having a shorter cross-sectional diameter than the first opening width S1 pass through the slits of the first sieve 30*a* while the substances each having a longer cross-sectional diameter than the first opening width S1 are left on the first sieve 30*a*.

In the raw material input on the first sieve 30*a*, the substances that have passed through the slits of the first sieve 30*a* drop on the first trough 15*a* while the substances that have not passed drop on the reprocessing container 36 from the front end of the first sieve 30*a*. That is, the substances each having a longer cross-sectional diameter than the first opening width S1 are collected in the reprocessing container 36. The raw material that has dropped on the reprocessing container 36 is ground again as needed, is then input on the first sieve 30*a*, and undergoes the similar sieving operation again.

The raw material that has dropped on the first trough 15*a* moves forward on the first trough 15*a* based on the vibration transmitted from the first vibration applying unit 13*a* and drops on a second sieve 30*b* of the second classification device 10*b* from the front end of the first trough 15*a*. That is, the substances each having a shorter cross-sectional diameter than the first opening width S1 drop on the second sieve 30*b* via a second inlet 11*b*.

Next, respective components of the second classification device 10*b* will be described.

The second classification device 10*b* includes the second inlet 11*b*, a second vibration applying unit 13*b*, a second trough 15*b*, and the second sieve 30*b*, and a second sieving process (a second upstream process) is performed with use of the second sieve 30*b*.

A raw material to be sieved in the second sieving process is input on the second sieve 30*b* from the front end of the first trough 15*a* via the second inlet 11*b* in a state in which the input amount thereof is adjusted.

Similarly to the first vibration applying unit 13*a*, the second vibration applying unit 13*b* is a unit, such as an electromagnetic feeder and a vibrating feeder, applying vibration in the approximately horizontal direction to a member attached to an upper portion thereof (the second trough 15*b* or the like).

The second trough 15*b* is attached to the upper portion of the second vibration applying unit 13*b*, and the second sieve 30*b* is attached to an upper portion of the second trough 15*b*. Meanwhile, the right sides, as seen in FIGS. 1 and 2, of the second trough 15*b* and the second sieve 30*b* are inclined downward.

Similarly to the case of the first classification device 10*a*, it is preferable to provide side surfaces of the second trough 15*b* and the second sieve 30*b* with sidewalls to prevent the raw material from coming off of the side surfaces during movement.

Positional relationship between the first classification device 10*a* and the second classification device 10*b* is set so that the raw material from the first trough 15*a* of the first classification device 10*a* may drop at a rear end of the second sieve 30*b* via the second inlet 11*b*.

Similarly to the first sieve 30*a*, the second sieve 30*b* is constituted by a screen having holes each having a slit width of a second opening width S2, which is shorter than the first opening width S1 (S2<S1), such as a wedge wire screen.

The raw material that has dropped on the second sieve 30*b* moves forward on the second sieve 30*b* based on the vibration transmitted from the second vibration applying unit 13*b*.

In the raw material on the second sieve 30*b*, only the substances each having a shorter cross-sectional diameter than the first opening width S1 exist, and substances each having a shorter cross-sectional diameter than the second opening width S2 pass through the slits of the second sieve 30*b* while substances each having a longer cross-sectional diameter than the second opening width S2 are left on the second sieve 30*b*.

In the raw material that has dropped on the second sieve 30*b*, the substances that have passed through the slits of the second sieve 30*b* drop on the second trough 15*b* while the substances that have not passed drop on a third sieve 30*c* of the third classification device 10*c* from a front end of the second sieve 30*b*. That is, the substances each of whose cross-sectional diameters is shorter than the first opening width S1 and longer than the second opening width S2 drop on the third sieve 30*c* via a third inlet 11*c*.

The raw material that has dropped on the second trough 15*b* moves forward on the second trough 15*b* based on the vibration transmitted from the second vibration applying unit 13*b* and drops on a fourth sieve 30*d* of the fourth classification device 10*d* from a front end of the second trough 15*b*. That is, the substances each having a shorter cross-sectional diameter than the second opening width S2 drop on the fourth sieve 30*d* via a fourth inlet 11*d*. Meanwhile, in the first classification device 10*a* and the second classification device 10*b*, a raw material having a high aspect ratio (a shape index, a ratio of a surface diameter to a thickness of a plate-like substance, or a ratio of a length in a longer direction to a diameter of a needle-like substance or a fibrous substance) is allowed to pass through the respective sieves (the first sieve 30*a* and the second sieve 30*b*) vertically, and both the vibration applying units (the first vibration applying unit 13*a* and the second vibration applying unit 13*b*) may thus be units that can apply vibration to the members attached to the upper portions not only in two-dimensional directions including a front-rear direction and a right-left direction but also in three-dimensional directions including a vertical direction.

Next, respective components of the third classification device 10*c* will be described.

The third classification device 10*c* includes the third inlet 11*c*, a third vibration applying unit 13*c*, a third trough 15*c*, the third sieve 30*c*, a first container 37*a*, and a second container 37*b*, and a third sieving process (a first downstream process) is performed with use of the third sieve 30*c*.

A raw material to be sieved in the third sieving process is input on the third sieve 30*c* from the front end of the second sieve 30*b* via the third inlet 11*c* in a state in which the input amount thereof is adjusted.

Similarly to the first vibration applying unit 13*a*, the third vibration applying unit 13*c* is a unit, such as an electromagnetic feeder and a vibrating feeder, applying vibration in the approximately horizontal direction to a member attached to an upper portion thereof (the third trough 15*c* or the like).

The third trough 15*c* is attached to the upper portion of the third vibration applying unit 13*c*, and the third sieve 30*c* is attached to an upper portion of the third trough 15*c*. Meanwhile, the right sides, as seen in FIGS. 1 and 2, of the third trough 15*c* and the third sieve 30*c* are inclined downward.

Similarly to the cases of the first classification device 10*a* and the second classification device 10*b*, it is preferable to provide side surfaces of the third trough 15*c* and the third sieve 30*c* with sidewalls to prevent the raw material from coming off of the side surfaces during movement. Meanwhile, illustration of such sidewalls is omitted except in FIG. 6 to show structures of the side surfaces.

Positional relationship between the second classification device 10*b* and the third classification device 10*c* is set so that the raw material from the second sieve 30*b* of the second classification device 10*b* may drop at a rear end of the third sieve 30*c* via the third inlet 11*c*.

The third sieve 30*c* is constituted by a porous plate which is flat at least at an upper surface thereof, such as a punching metal mesh (a punching metal) having round holes (approximately circular holes). As a method for forming a plurality of round holes in a steel plate, a method for laser-cutting the steel plate (a laser-processed metal mesh) or a method for opening holes by corroding the steel plate with chemicals (a chemical-treated metal mesh), as well as the method for punching the steel plate (the punching metal mesh), may be employed.

A hole diameter d1 of the porous plate in the third sieve 30*c* is set to be longer than the slit width of the first sieve 30*a* (the first opening width S1) (S1<d1).

Also, it is preferable to set a thickness d2 of the porous plate constituting the third sieve 30*c* to be longer than the hole diameter (the hole diameter d1) (d1<d2)

Figure 7:
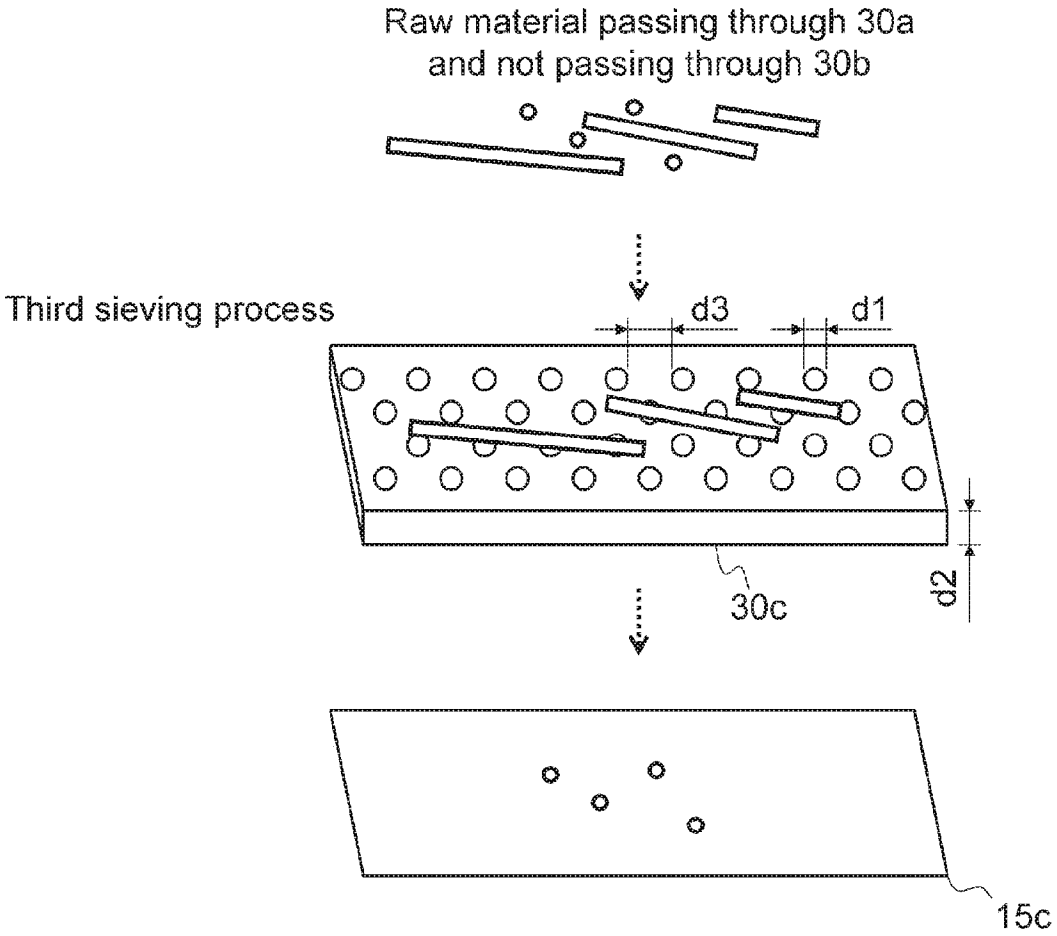
FIG. 7 is a schematic view illustrating configurations of the third sieve and a third trough and the flow of the object to be sieved.

It is also preferable to set a distance d3 between the adjacent holes in the third sieve 30*c* to be longer than the hole diameter d1 (refer to FIG. 7). Setting the inter-hole distance to be longer can decrease the possibility that a substance on the third sieve 30*c* having a relatively high aspect ratio is inclined with an edge of a hole as a fulcrum and then passes through the hole.

The raw material that has dropped on the third sieve 30*c* moves forward on the third sieve 30*c* based on the vibration transmitted from the third vibration applying unit 13*c*.

In the raw material on the third sieve 30*c*, only the substances each having a shorter cross-sectional diameter than the first opening width S1 exist, and among these substances, approximately spherical substances each of which is shorter in a longer direction than the hole diameter d1 of the porous plate in the third sieve 30*c* pass through the holes of the third sieve 30*c* while elongated substances (substances each having a high aspect ratio) are left on the third sieve 30*c*.

In the raw material that has dropped on the third sieve 30*c*, the substances that have passed through the holes of the third sieve 30*c* drop on the third trough 15*c* while the substances that have not passed drop on the first container 37*a* from a front end of the third sieve 30*c*. In this manner, the substances each of whose cross-sectional diameters is shorter than the first opening width S1 and longer than the second opening width S2 and each of which has a high aspect ratio (elongated substances) are collected in the first container 37*a*.

The raw material that has dropped on the third trough 15*c* moves forward on the third trough 15*c* based on the vibration transmitted from the third vibration applying unit 13*c* and drops on the second container 37*b* from a front end of the third trough 15*c*. In this manner, the substances each of whose cross-sectional diameters is shorter than the first opening width S1 and longer than the second opening width S2 and each of which has a low aspect ratio (approximately spherical substances) are collected in the second container 37*b*.

Meanwhile, in the raw material that has dropped on the third sieve 30*c*, even the substances each of whose dimensions in the longer direction is longer than the hole diameter d1 of the third sieve 30*c* (elongated substances) may pass through the holes of the third sieve 30*c* when each of the substances has a shorter dimension in a shorter direction than the hole diameter d1.

However, in the first embodiment, since the porous plate constituting the third sieve 30*c* has the longer thickness d2 than the hole diameter d1, the elongated substances will not pass through the holes vertically unless the elongated substances reach the bottoms (the lower portions) of the holes at end portions thereof in an erected state. Accordingly, the elongated substances are less likely to pass through the holes of the third sieve 30*c* (In an inclined state, the elongated substances couldn't pass through the third sieve 30*c* when the elongated substances enter the holes at the end portions thereof. This is because the entrance could be hindered by the thick parts of the holes in the inclined state.).

Also, since the third sieve 30*c* is constituted by the porous plate made by punching holes in a flat plate, a surface (an upper surface) mounting the raw material can be flatter than in a case in which the third sieve 30*c* is constituted by a mesh made by weaving linear members such as wires in a lattice pattern. This can prevent the elongated substances from being inclined by roughness of the surface mounting the raw material and easily passing through the holes of the third sieve 30*c*.

Accordingly, in the raw material that has dropped on the third sieve 30*c*, only the approximately spherical substances each having a low aspect ratio pass through the holes of the third sieve 30*c*, and sieving into the elongated substances each having a high aspect ratio and the approximately spherical substances each having a low aspect ratio can be performed.

Next, respective components of the fourth classification device 10*d* will be described.

The fourth classification device 10*d* includes the fourth inlet 11*d*, a fourth vibration applying unit 13*d*, a fourth trough 15*d*, the fourth sieve 30*d*, a third container 37*c*, and a fourth container 37*d*, and a fourth sieving process (a second downstream process) is performed with use of the fourth sieve 30*d*.

A raw material to be sieved in the fourth sieving process is input on the fourth sieve 30*d* from the front end of the second trough 15*b* via the fourth inlet 11*d* in a state in which the input amount thereof is adjusted.

Similarly to the first vibration applying unit 13*a*, the fourth vibration applying unit 13*d* is a unit, such as an electromagnetic feeder and a vibrating feeder, applying vibration in the approximately horizontal direction to a member attached to an upper portion thereof (the fourth trough 15*d* or the like).

The fourth trough 15*d* is attached to the upper portion of the fourth vibration applying unit 13*d*, and the fourth sieve 30*d* is attached to an upper portion of the fourth trough 15*d*. Meanwhile, the right sides, as seen in FIGS. 1 and 2, of the fourth trough 15*d* and the fourth sieve 30*d* are inclined downward.

Similarly to the case of the third classification device 10*c*, it is preferable to provide side surfaces of the fourth trough 15*d* and the fourth sieve 30*d* with sidewalls to prevent the raw material from coming off of the side surfaces during movement.

Positional relationship between the second classification device 10*b* and the fourth classification device 10*d* is set so that the raw material from the second trough 15*b* of the second classification device 10*b* may drop at a rear end of the fourth sieve 30*d* via the fourth inlet 11*d*.

The fourth sieve 30*d* is constituted by a porous plate which is flat at least at an upper surface thereof, such as a punching metal mesh (a punching metal) having round holes (approximately circular holes). As a method for forming a plurality of round holes in a steel plate, a method for laser-cutting the steel plate (a laser-processed metal mesh) or a method for opening holes by corroding the steel plate with chemicals (a chemical-treated metal mesh), as well as the method for punching the steel plate (the punching metal mesh), may be employed, in a similar manner to the case of the third sieve 30*c*.

A hole diameter d4 of the porous plate in the fourth sieve 30*d* is set to be longer than the slit width of the second sieve 30*b* (the second opening width S2) and to be shorter than the slit width of the first sieve 30*a* (the first opening width S1) (S2<d4<S1).

Also, it is preferable to set a thickness d5 of the porous plate constituting the fourth sieve 30*d* to be longer than the hole diameter (the hole diameter d4) (d4<d5)

Figure 8:
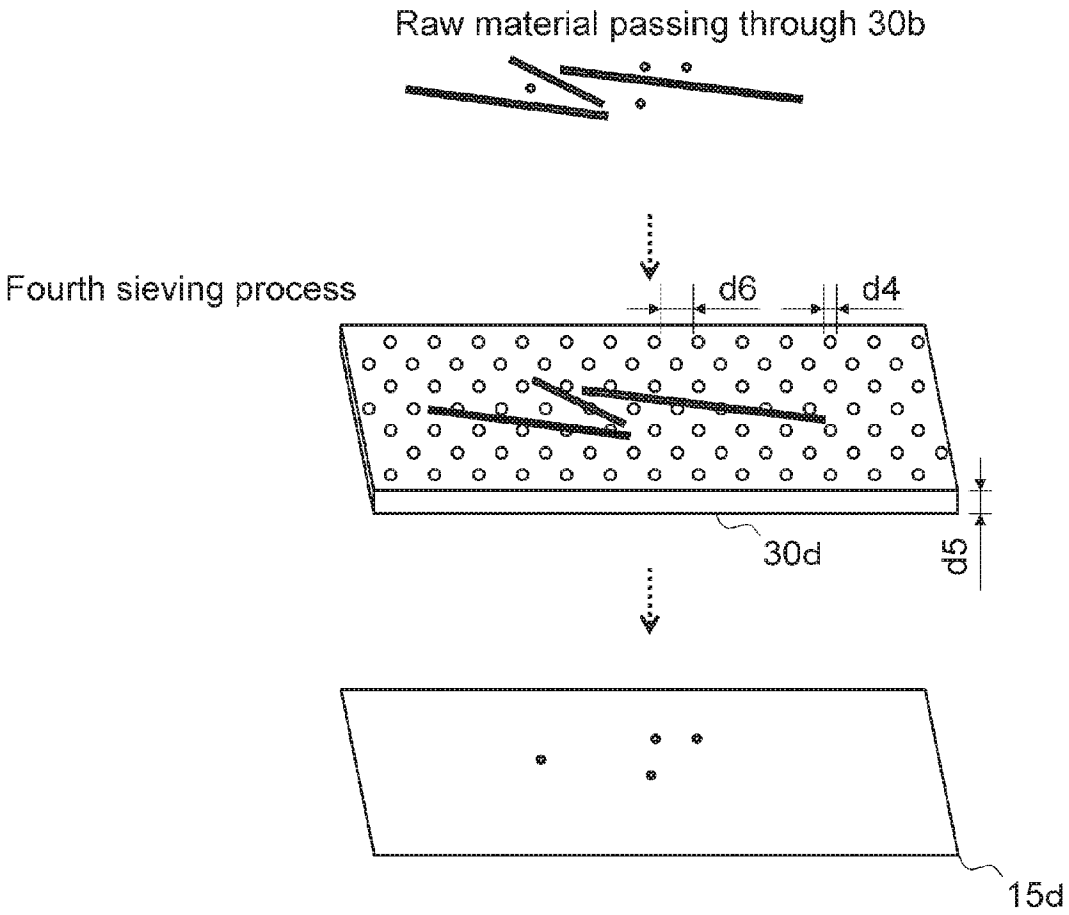
FIG. 8 is a schematic view illustrating configurations of the fourth sieve and a fourth trough and the flow of the object to be sieved.

It is also preferable to set a distance d6 between the adjacent holes in the fourth sieve 30*d* to be longer than the hole diameter d4 (refer to FIG. 8). Setting the inter-hole distance to be longer can decrease the possibility that a substance on the fourth sieve 30*d* having a relatively high aspect ratio is inclined with an edge of a hole as a fulcrum and then passes through the hole.

The raw material that has dropped on the fourth sieve 30*d* moves forward on the fourth sieve 30*d* based on the vibration transmitted from the fourth vibration applying unit 13*d*.

In the raw material on the fourth sieve 30*d*, only the substances each having a shorter cross-sectional diameter than the second opening width S2 exist, and among these substances, approximately spherical substances each of which is shorter in a longer direction than the hole diameter d4 of the porous plate in the fourth sieve 30*d* pass through the holes of the fourth sieve 30*d* while elongated substances (substances each having a high aspect ratio) are left on the fourth sieve 30*d*.

In the raw material that has dropped on the fourth sieve 30*d*, the substances that have passed through the holes of the fourth sieve 30*d* drop on the fourth trough 15*d* while the substances that have not passed drop on the third container 37*c* from a front end of the fourth sieve 30*d*. In this manner, the substances each of whose cross-sectional diameters is shorter than the second opening width S2 and each of which has a high aspect ratio (elongated substances) are collected in the third container 37*c*.

The raw material that has dropped on the fourth trough 15*d* moves forward on the fourth trough 15*d* based on the vibration transmitted from the fourth vibration applying unit 13*d* and drops on the fourth container 37*d* from a front end of the fourth trough 15*d*. In this manner, the substances each of whose cross-sectional diameters is shorter than the second opening width S2 and each of which has a low aspect ratio (approximately spherical substances) are collected in the fourth container 37*d*.

Meanwhile, in the raw material that has dropped on the fourth sieve 30*d*, even the substances each of whose dimensions in the longer direction is longer than the hole diameter d4 of the fourth sieve 30*d* (elongated substances) may pass through the holes of the fourth sieve 30*d* when each of the substances has a shorter dimension in a shorter direction than the hole diameter d4.

However, in the first embodiment, since the porous plate constituting the fourth sieve 30*d* has the longer thickness d5 than the hole diameter d4, the elongated substances will not pass through the holes vertically unless the elongated substances reach the bottoms (the lower portions) of the holes at end portions thereof in an erected state. Accordingly, the elongated substances are less likely to pass through the holes of the fourth sieve 30*d* (In an inclined state, the elongated substances couldn't pass through the fourth sieve 30*d* when the elongated substances enter the holes at the end portions thereof. This is because the entrance could be hindered by the thick parts of the holes in the inclined state.).

Also, since the fourth sieve 30*d* is constituted by the porous plate made by punching holes in a flat plate, a surface (an upper surface) mounting the raw material can be flatter than in a case in which the fourth sieve 30*d* is constituted by a mesh made by weaving linear members such as wires in a lattice pattern. This can prevent the elongated substances from being inclined by roughness of the surface mounting the raw material and easily passing through the holes of the fourth sieve 30*d*.

Accordingly, in the raw material that has dropped on the fourth sieve 30*d*, only the approximately spherical substances each having a low aspect ratio pass through the holes of the fourth sieve 30*d*, and sieving into the elongated substances each having a high aspect ratio and the approximately spherical substances each having a low aspect ratio can be performed.

Meanwhile, in the third classification device 10*c* and the fourth classification device 10*d*, to prevent a raw material having a high aspect ratio from passing through the respective sieves (the third sieve 30*c* and the fourth sieve 30*d*) vertically, both the vibration applying units (the third vibration applying unit 13*c* and the fourth vibration applying unit 13*d*) are preferably units that do not apply vibration in the vertical direction to the members attached to the upper portions, that is, units that can apply vibration in the two-dimensional directions including the front-rear direction and the right-left direction, and are more preferably units that apply vibration in a one-dimensional direction including the front-rear direction.

As described above in detail, in the first embodiment, sieving (separation) based on the difference in cross-sectional diameter can be performed at a slit-like first sieving portion (the first sieve 30*a* and the second sieve 30*b*), and sieving (separation) based on the difference in aspect ratio can be performed at a porous second sieving portion (the third sieve 30*c* and the fourth sieve 30*d*).

Meanwhile, although the mode in which two-stage sieving is performed at the first sieving portion has been described in the first embodiment, a mode in which rough separation (whether the cross-sectional diameter is longer or shorter than a certain length) is performed by one-stage sieving or a mode in which fine separation is performed by three-or-more-stage sieving may be employed.

Figure 16:
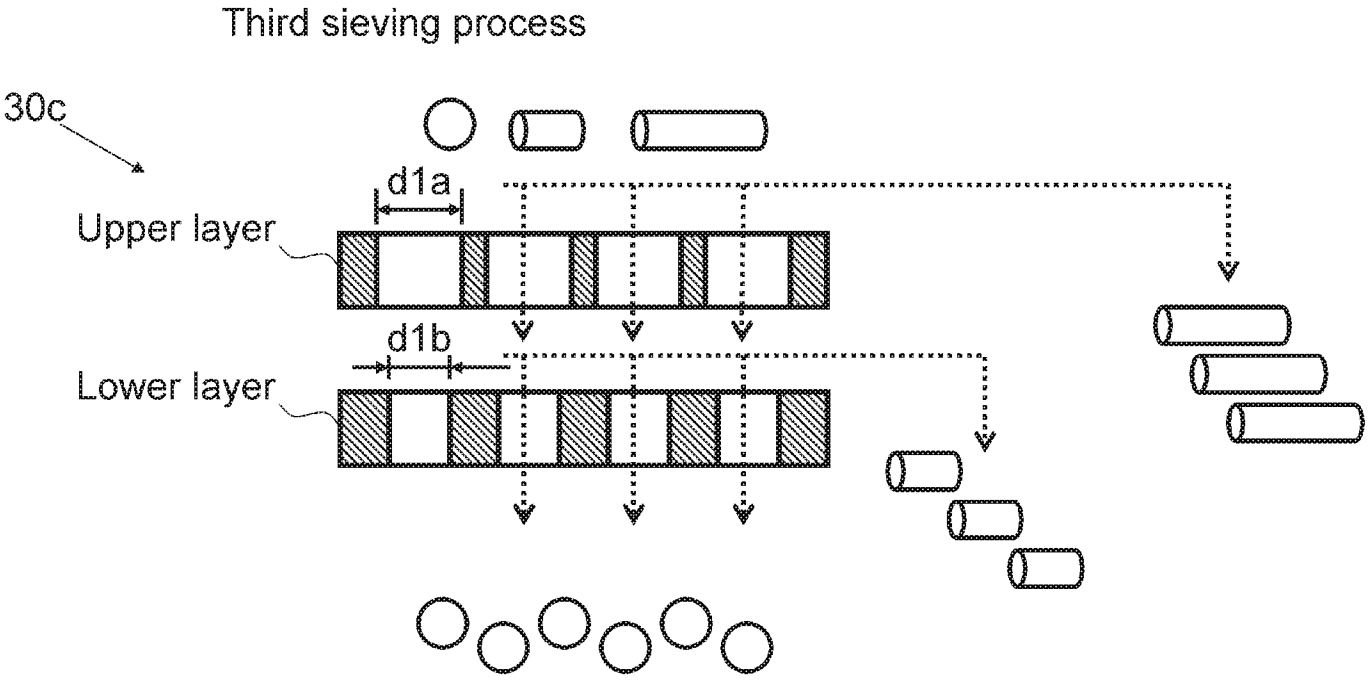
FIG. 16 is a schematic view illustrating the flow of the object to be sieved in an example in which the third sieve includes two porous plates.

Also, although one-stage sieving is performed in which the hole diameter d of the porous plate in the second sieving portion is longer than the opening width S of the elongated hole or slit in the first sieving portion (S<d) in the first embodiment, a mode may be employed in which porous plates having different hole diameters are provided in plural layers, and in which the hole diameter of the porous plate in the former layer (the upper layer) is set to be longer than the hole diameter of the porous plate in the latter layer (the lower layer) (both the hole diameters of the respective porous plates are longer than the opening width S), to finely separate substances having approximately equal cross-sectional diameters based on the difference in aspect ratio (refer to FIG. 16). FIG. 16 illustrates an example in which the third sieve 30*c* in the second sieving portion includes two porous plates, in which a hole diameter d1*a* of the porous plate in the former layer (the upper layer) is set to be longer than a hole diameter d1*b* of the porous plate in the latter layer (the lower layer), and in which both the hole diameters d1*a* and d1*b* of the respective porous plates are longer than the first opening width S1, and a similar configuration may be employed in the fourth sieve 30*d*.

With use of the first classification device 10*a* and the second classification device 10*b*, sieving of the input raw material can be performed based on the length of the cross-sectional diameter (separation based on the difference in cross-sectional diameter). With use of the third classification device 10*c*, sieving of the raw material sieved in the second classification device 10*b* and having a relatively long cross-sectional diameter (the raw material whose minimum cross-sectional diameter is shorter than toe opening width of the first sieve and longer than the opening width of the second sieve) into the elongated substances and the approximately spherical substances (separation based on the difference in aspect ratio) can be performed. With use of the fourth classification device 10*d*, sieving of the raw material sieved in the second classification device 10*b* and having a relatively short cross-sectional diameter (the raw material whose minimum cross-sectional diameter is shorter than the opening width of the second sieve) into the elongated substances and the approximately spherical substances (separation based on the difference in aspect ratio) can be performed.

In particular, since positional relationship among the first classification device 10*a* to the fourth classification device 10*d* is set so that the raw material may drop from the front end of the first trough 15*a* of the first classification device 10*a* at the upper rear portion of the second sieve 30*b* of the second classification device 10*b* via the second inlet 11*b*, so that the raw material may drop from the front end of the second sieve 30*b* of the second classification device 10*b* at the upper rear portion of the third sieve 30*c* of the third classification device 10*c* via the third inlet 11*c*, and so that the raw material may drop from the front end of the second trough 15*b* of the second classification device 10*b* at the upper rear portion of the fourth sieve 30*d* of the fourth classification device 10*d* via the fourth inlet 11*d*, the first sieving process to the fourth sieving process can be performed successively.

Also, by adjusting the input amount of the raw material into the first inlet 11*a*, sieving speed in the first sieve 30*a* to the fourth sieve 30*d* can be adjusted.

Meanwhile, the first opening width S1, the second opening width S2, the hole diameter d1 of the porous plate in the third sieve 30*c*, and the hole diameter d4 of the porous plate in the fourth sieve 30*d* can be set arbitrarily depending on the kind of the raw material to be sieved and the purpose of the sieving.

Figure 9:
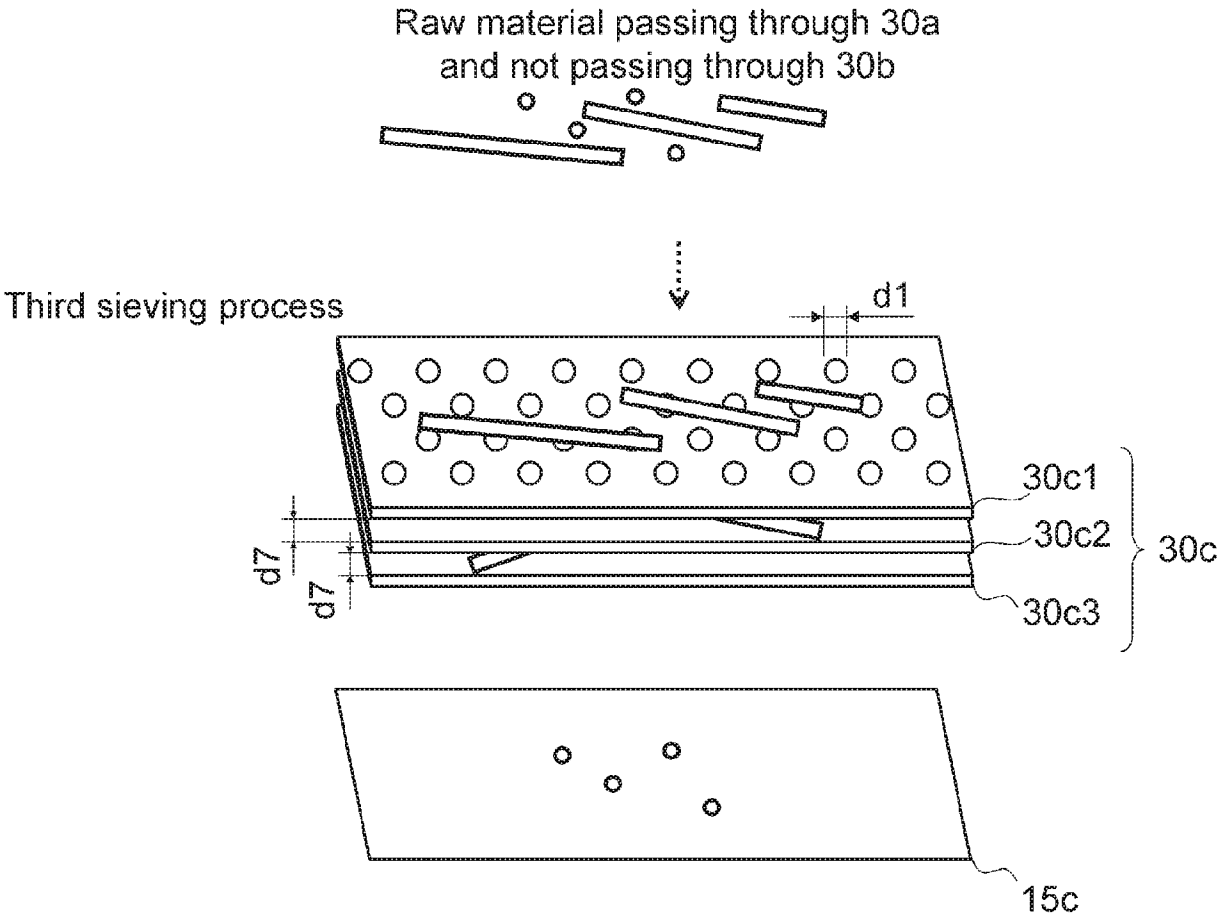
FIG. 9 is a schematic view illustrating configurations of the third sieve including porous plates and the third trough and the flow of the object to be sieved according to a second embodiment.

Although the mode has been described in the first embodiment in which the thickness d2 (or d5) of the porous plate is set to be longer than the hole diameter d1 (or d4) to make it difficult for substances each having a high aspect ratio (needle-like substances and fibrous substances) to pass through the third sieve 30*c* or the fourth sieve 30*d*, a mode in which the third sieve 30*c* or the fourth sieve 30*d* includes a plurality of porous plates may be employed instead of the mode in which the third sieve 30*c* or the fourth sieve 30*d* includes one porous plate (a second embodiment, refer to FIG. 9). In this case, the thickness d2 (or d5) of the porous plate may be shorter than the hole diameter d1 (or d4)

The higher the aspect ratio of a substance is, the less possible it is for the substance, even when the substance enters a hole of a first porous plate (a first plate 30*c*1), to enter holes of second and subsequent porous plates (a second plate 30*c*2 and a third plate 30*c*3). Consequently, this can significantly decrease the possibility that the substance passes through the third sieve 30*c* (or the fourth sieve 30*d*).

In this case, in a case in which the hole diameters are relatively long, or in a case in which the respective porous plates (the first plate 30*c*1, the second plate 30*c*2, and the third plate 30*c*3) are arranged so that the holes of the respective porous plates may not be misaligned (so that the holes of the respective porous plates may overlap in the vertical direction), the porous plates are preferably arranged so that a distance d7 between the plurality of porous plates may be approximately equal to or shorter than the hole diameter d1 of the third sieve 30*c* to prevent substances that are not desired to pass through the third sieve 30*c* (substances each having a high aspect ratio) in an object to be sieved from passing through the plurality of porous plates, although the arrangement differs with the hole diameters of the porous plates.

However, in a case in which the respective porous plates (the first plate 30*c*1, the second plate 30*c*2, and the third plate 30*c*3) are arranged so that the holes of the respective porous plates may be misaligned (so that the holes of the respective porous plates may not overlap in the vertical direction), the distance d7 between the plurality of porous plates is preferably equal to or longer than the hole diameter d1 of the third sieve 30*c*.

The same is true of the fourth sieve 30*d* (not illustrated).

Figure 10:
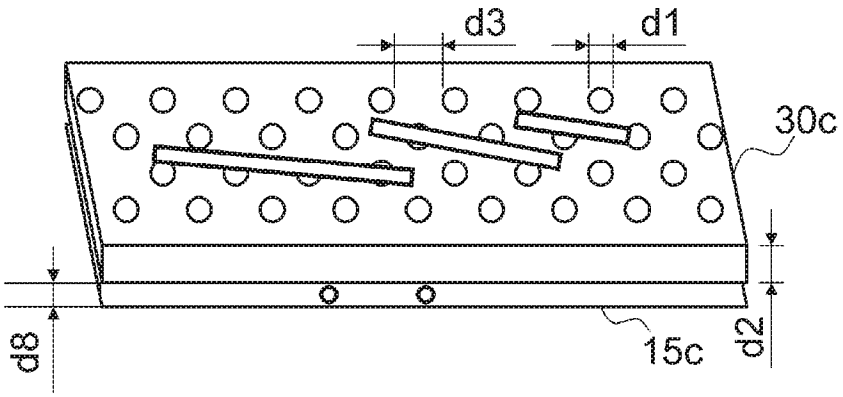
FIG. 10 is a schematic view illustrating configurations of the third sieve and the third trough in which a distance between the sieve and the trough is set to be short, and the flow of the object to be sieved according to a third embodiment.

Also, a mode may be employed in which a distance d8 between the third sieve 30*c* and the third trough 15*c* (or a flat plate provided between the third sieve 30*c* and the third trough 15*c*) is set to be approximately equal to the hole diameter d1 of the third sieve 30*c* to make it difficult for the substances each having a high aspect ratio to pass through the third sieve 30*c* (a third embodiment, refer to FIG. 10).

Similarly, a mode may be employed in which a distance between the fourth sieve 30*d* and the fourth trough 15*d* (or a flat plate provided between the fourth sieve 30*d* and the fourth trough 15*d*) is set to be approximately equal to the hole diameter d4 of the fourth sieve 30*d* to make it difficult for the substances each having a high aspect ratio to pass through the fourth sieve 30*d* (not illustrated).

Figure 11:
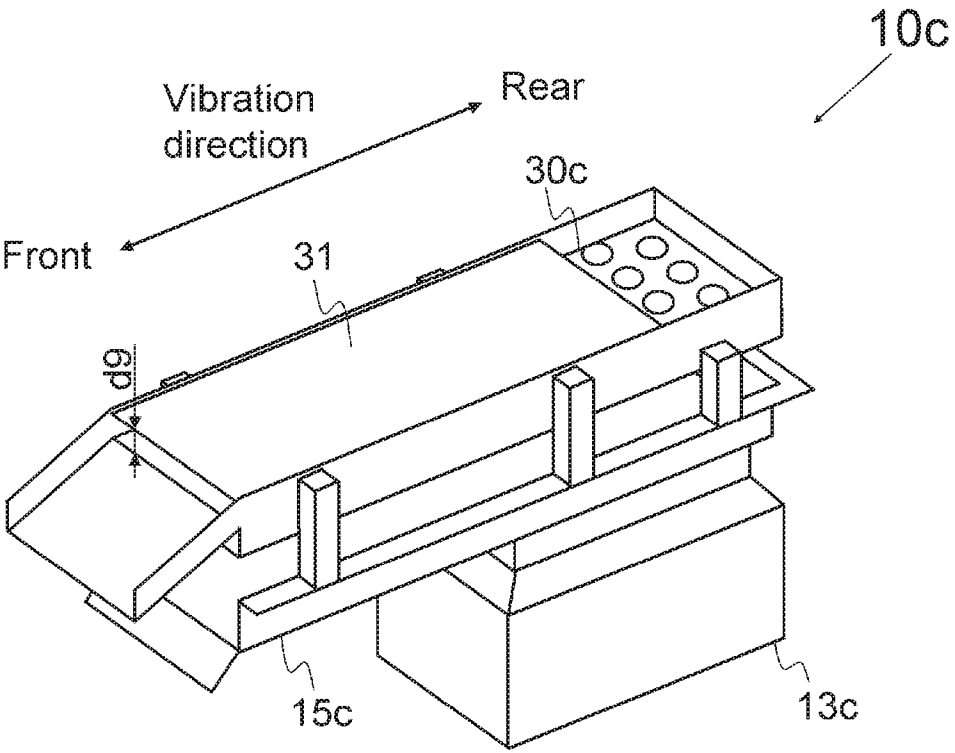
FIG. 11 is a perspective view illustrating the third classification device provided with a lid according to a fourth embodiment.

Also, from a viewpoint of making it difficult for the substances each having a high aspect ratio to pass through the third sieve 30*c* by making it difficult for the substances each having a high aspect ratio to erect in the vertical direction, a mode in which an upper portion of the third sieve 30*c* is provided with a lid (a flat plate) 31 close to the upper portion (at a distance d9, which is approximately equal to the hole diameter d1 of the third sieve 30*c*) may be employed (a fourth embodiment, refer to FIG. 11).

Similarly, a mode in which an upper portion of the fourth sieve 30*d* is provided with a lid (a flat plate) close to the upper portion (at a distance approximately equal to the hole diameter d4 of the fourth sieve 30*d*) may be employed (not illustrated).

Figure 12:
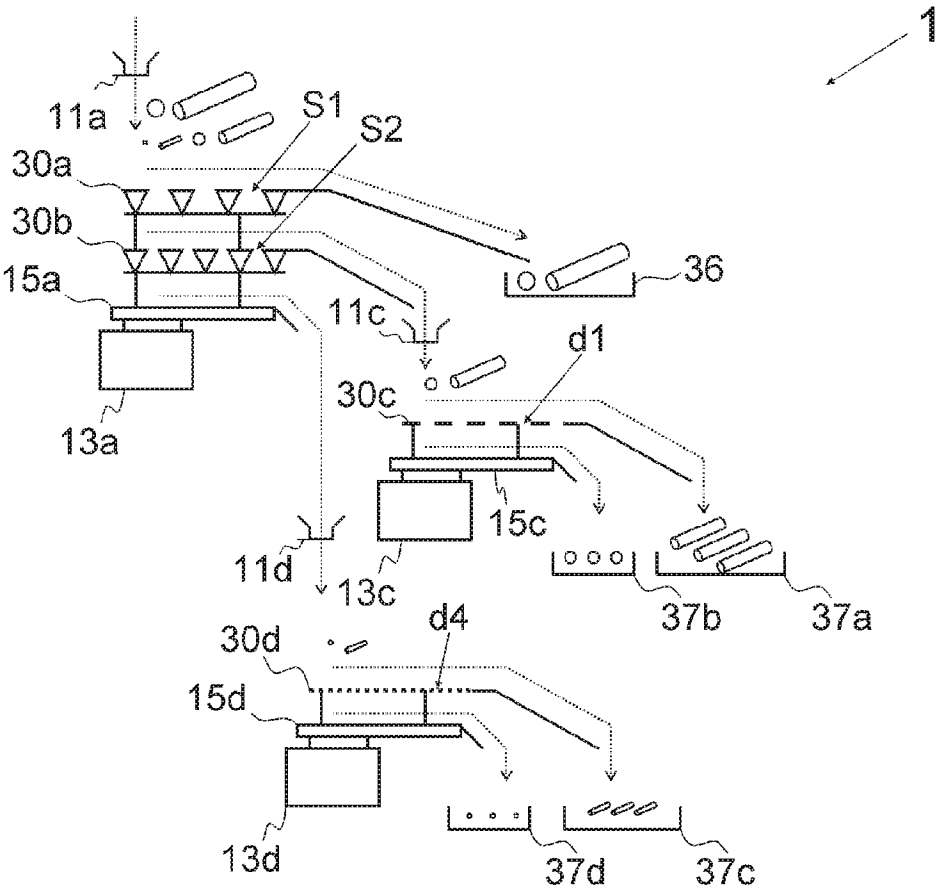
FIG. 12 is a schematic view illustrating a configuration of the sieving apparatus according to a fifth embodiment.

Although the mode has been described in the first embodiment in which the first classification device 10*a* and the second classification device 10*b* are provided separately, a mode may be employed in which the first vibration applying unit 13*a* is shared, in which the second sieve 30*b* is attached to the upper portion of the first trough 15*a*, and in which the first sieve 30*a* is attached to the upper portion of the second sieve 30*b* (a fifth embodiment, refer to FIG. 12). By doing so, the first sieving process and the second sieving process can be performed with use of one vibration applying unit.

Figure 13:
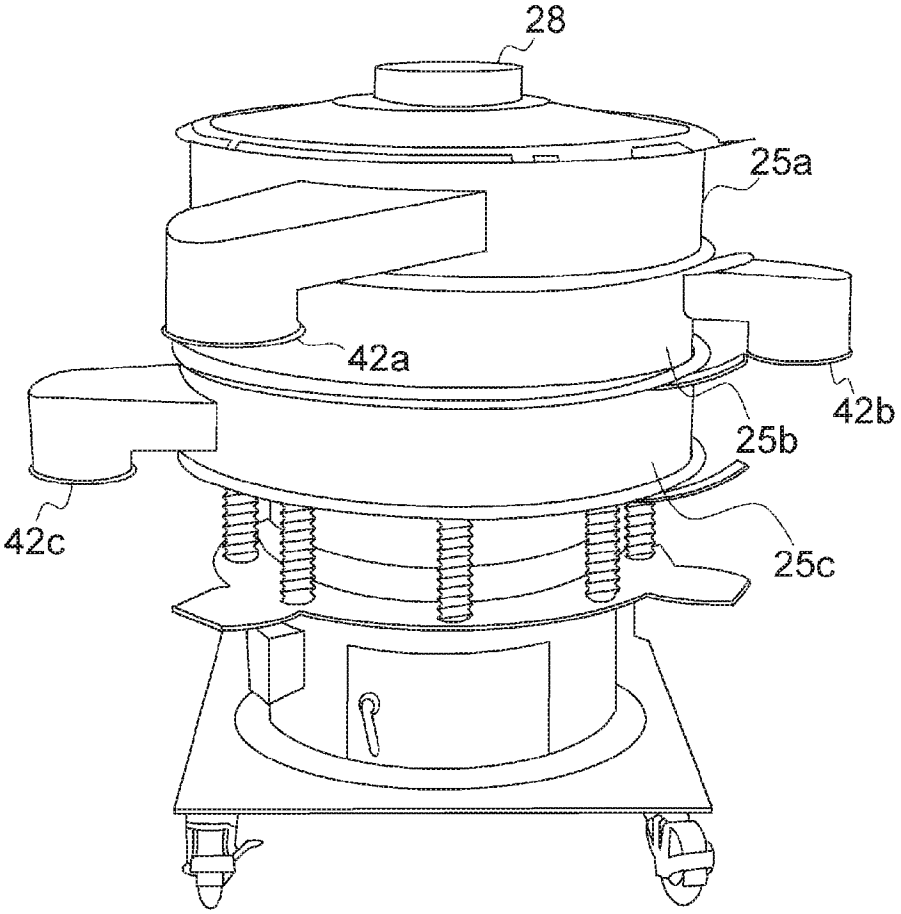
FIG. 13 is a perspective view of a first sieving portion according to a sixth embodiment.
Figure 14:
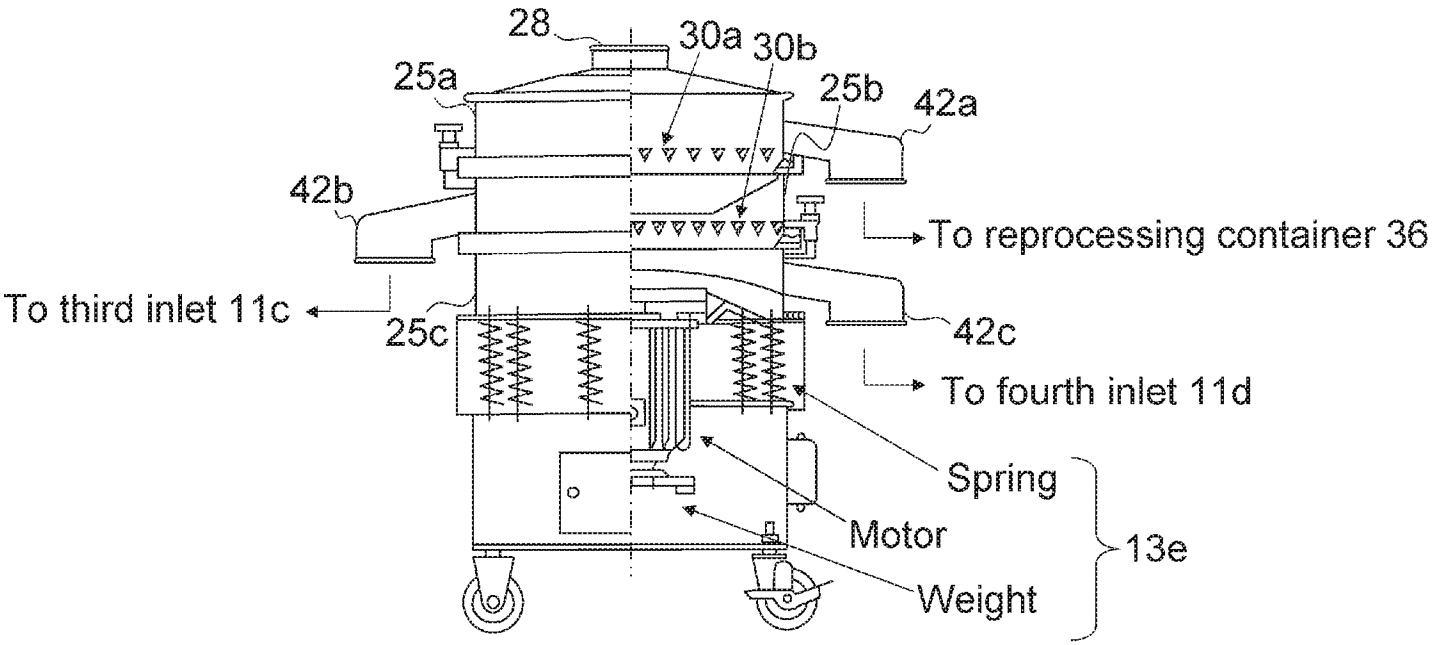
FIG. 14 is a side view (left half) and a cross-sectional view (right half) of the first sieving portion according to the sixth embodiment.

Also, the first vibration applying unit 13*a* and the second vibration applying unit 13*b* is not limited to a unit, such as a vibrating feeder, applying vibration in the horizontal direction, and a mode of using another unit, such as a unit applying vibration in the vertical direction as well via an elastic member such as a spring, may be employed (a sixth embodiment, refer to FIGS. 13 and 14).

The sixth embodiment is an example of the first sieving portion in which the second sieve 30*b* is attached to an upper portion of a fifth vibration applying unit 13*e* including a motor, a weight, and a spring, and in which the first sieve 30*a* is attached to the upper portion of the second sieve 30*b*.

A frame at an upper portion of the first sieve 30*a* (an upper cylindrical frame 25*a*) is provided with an upper discharge portion 42*a* adapted to discharge a raw material that is input from a raw material inlet 28 and that does not pass through the slits of the first sieve 30*a* (substances each of whose cross-sectional diameters is longer than the first opening width S1), and the substances each of whose cross-sectional diameters is longer than the first opening width S1 are discharged via the upper discharge portion 42*a* and are collected in the reprocessing container 36.

A frame between the first sieve 30*a* and the second sieve 30*b* (a middle cylindrical frame 25*b*) is provided with a middle discharge portion 42*b* adapted to discharge a raw material that is input from the raw material inlet 28, that passes through the slits of the first sieve 30*a*, and that does not pass through the slits of the second sieve 30*b* (substances each of whose cross-sectional diameters is longer than the second opening width S2 and shorter than the first opening width S1), and the substances each of whose cross-sectional diameters is longer than the second opening width S2 and shorter than the first opening width S1 are discharged via the middle discharge portion 42*b* and drop on the third sieve 30*c* of the third classification device 10*c* via the third inlet 11*c*.

A frame at a lower portion of the second sieve 30*b* (a lower cylindrical frame 25*c*) is provided with a lower discharge portion 42*c* adapted to discharge a raw material that is input from the raw material inlet 28 and that passes through the slits of the first sieve 30*a* and the second sieve 30*b* (substances each of whose cross-sectional diameters is shorter than the second opening width S2), and the substances each of whose cross-sectional diameters is shorter than the second opening width S2 are discharged via the lower discharge portion 42*c* and drop on the fourth sieve 30*d* of the fourth classification device 10*d* via the fourth inlet 11*d*.

Also, the third vibration applying unit 13*c* and the fourth vibration applying unit 13*d* is not limited to a unit, such as a vibrating feeder, applying vibration in the horizontal direction, and may be another vibration applying unit applying vibration in the horizontal direction.

Figure 15:
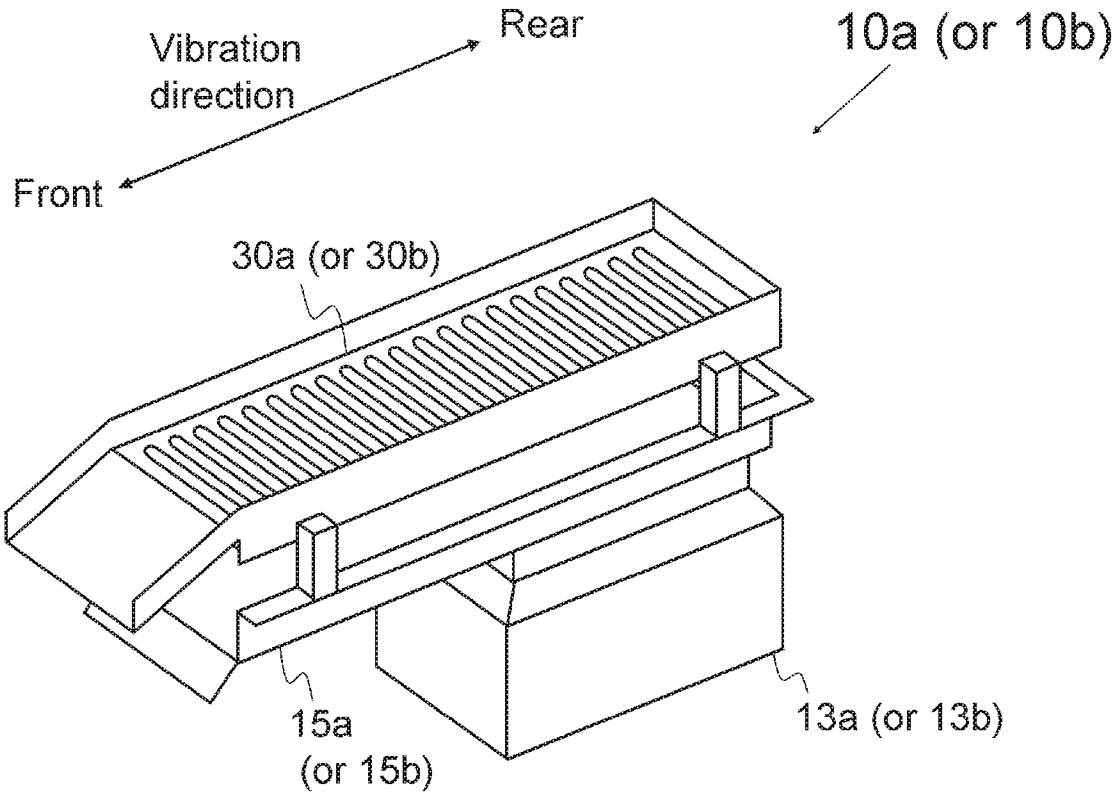
FIG. 15 is a perspective view illustrating the first classification device (or the second classification device) having a sieve provided with elongated round holes.

Also, although the mode has been described in which the sieve included in the first sieving portion (the first sieve 30*a* and the second sieve 30*b*) is constituted by the wedge wire screen, a mode may be employed in which the sieve is provided with a plurality of elongated holes (elongated rectangular holes or elongated round holes), such as a mode in which the sieve is constituted by a punching metal mesh (a punching metal) having elongated round holes (oval holes) (refer to FIG. 15). As a method for forming a plurality of elongated holes (oval holes) in a steel plate, a method for laser-cutting the steel plate (a laser-processed metal mesh) or a method for opening holes by corroding the steel plate with chemicals (a chemical-treated metal mesh), as well as the method for punching the steel plate (the punching metal mesh), may be employed.

Next, a sieving apparatus and a sieving method according to the present invention will be described specifically, using an example of separating bamboo into bamboo fibers (elongated substances each having a high aspect ratio) and parenchyma cells (substances also referred to as parenchymal tissues but are solely referred to as parenchyma cells herein, and each formed approximately in a spherical shape when ground and each having a low aspect ratio)

[Superheated Steam Treatment]

First, moso bamboo having a diameter of approximately 10 cm was cut into pieces each having a length of approximately 50 cm for use as a bamboo raw material.

Subsequently, to selectively decompose hemicellulose to facilitate fracturing of the bamboo, this bamboo raw material was subjected to a superheated steam treatment. The temperature of the superheated steam at this time was 200 to 250° C.

[Grinding Treatment]

This bamboo raw material subjected to the superheated steam treatment was roughly ground with use of Hammer Mill manufactured by NARA MACHINERY CO., LTD. (type HM-5, rotor diameter: 460 mm, number of revolutions: 1800 rpm, screen diameter: 20 mm) and was then finely ground with use of Jiyu Mill manufactured by NARA MACHINERY CO., LTD (type M-4, rotor diameter: 320 mm, number of revolutions: 4500 rpm, screen diameter: 4 mm). In this manner, the bamboo in which the bamboo fibers and the parenchyma cells were integrated was ground to prepare a mixture in which the bamboo fibers and the parenchyma cells are isolated from each other (an object to be sieved, hereinbelow simply referred to as a mixture in some cases). In this mixture, the bamboo fibers and the parenchyma cells are mostly isolated from each other, and there are distributions of the diameters and lengths of the bamboo fibers and of the particle diameters of the parenchyma cells.

Separation into the bamboo fibers and the parenchyma cells was performed with use of the sieving apparatus illustrated in FIG. 12 according to the fifth embodiment.

[Primary Classification Treatment (Upstream Process)]

In this apparatus, a wedge wire screen having a slit width (the first opening width S1) of 0.50 mm was set as the first sieve 30*a*, and a wedge wire screen having a slit width (the second opening width S2) of 0.18 mm was set as the second sieve 30*b*.

The first vibration applying unit 13*a* was operated to apply vibration to the first sieve 30*a*, the second sieve 30*b*, and the first trough 15*a*.

Subsequently, when the mixture was fed in a faxed amount per unit time from the first inlet 11*a* with use of an electromagnetic feeder, the mixture was input on the first sieve 30*a* and moved forward on the first sieve 30*a* based on the vibration transmitted from the first vibration applying unit 13*a*.

Subsequently, the bamboo fibers each having a shorter diameter than the slit width (the first opening width S1) and the parenchyma cells each having a shorter particle diameter than the slit width (the first opening width S1) passed through the slits of the first sieve 30*a* and dropped on the second sieve 30*b*. The mixture dropped on the second sieve 30*b* moved forward on the second sieve 30*b* based on the vibration transmitted from the first vibration applying unit 13*a* in a similar manner to the above.

Subsequently, the bamboo fibers each having a shorter diameter than the slit width (the second opening width S2) and the parenchyma cells each having a shorter particle diameter than the slit width (the second opening width S2) passed through the slits of the second sieve 30*b* and dropped on the first trough 15*a*.

The mixture left on the first sieve 30*a* moved forward on the first sieve 30*a* and dropped on the reprocessing container 36 from the front end of the first sieve 30*a*.

The mixture including the bamboo fibers and the parenchyma cells dropped on the reprocessing container 36 was subjected to the aforementioned grinding treatment again, was then input on the first sieve 30*a* from the first inlet 11*a*, and was subjected to the similar primary classification treatment again.

[Secondary Classification Treatment (Downstream Process)]

In this apparatus, a porous plate having the hole diameter d1 of 0.60 mm was set as the third sieve 30*c*, and a porous plate having the hole diameter d4 of 0.30 mm was set as the fourth sieve 30*d*.

The third vibration applying unit 13*c* was operated to apply vibration to the third sieve 30*c* and the third trough 15*c*, and the fourth vibration applying unit 13*d* was operated to apply vibration to the fourth sieve 30*d* and the fourth trough 15*d*.

The mixture passed through the first sieve 30*a* but left on the second sieve 30*b* moved forward on the second sieve 30*b* and dropped on the third sieve 30*c* from the front end of the second sieve 30*b* via the third inlet 11*c*, and the mixture passed through the second sieve 30*b* and dropped on the first trough 15*a* moved forward on the first trough 15*a* and successively dropped on the fourth sieve 30*d* from the front end of the first trough 15*a* via the fourth inlet 11*d*.

The mixture dropped on the third sieve 30*c* moved forward on the third sieve 30*c* based on the vibration transmitted from the third vibration applying unit 13*c*. While the approximately spherical (low aspect ratio) parenchyma cells passed through the holes of the third sieve 30*c* and dropped on the third trough 15*c*, the needle-like (high aspect ratio) bamboo fibers could not pass through the holes of the third sieve 30*c*.

The bamboo fibers, which were left on the third sieve 30*c*, moved forward on the third sieve 30*c* and dropped on the first container 37*a* from the front end of the third sieve 30*c*, and the parenchyma cells, which passed through the third sieve 30*c* and dropped on the third trough 15*c*, moved forward on the third trough 15*c* and dropped on the second container 37*b* from the front end of the third trough 15*c*.

Similarly, the mixture dropped on the fourth sieve 30*d* moved forward on the fourth sieve 30*d* based on the vibration transmitted from the fourth vibration applying unit 13*d*. While the approximately spherical (low aspect ratio) parenchyma cells passed through the holes of the fourth sieve 30*d* and dropped on the fourth trough 15*d*, the needle-like (high aspect ratio) bamboo fibers could not pass through the holes of the fourth sieve 30*d*.

The bamboo fibers, which were left on the fourth sieve 30*d*, moved forward on the fourth sieve 30*d* and dropped on the third container 37*c* from the front end of the fourth sieve 30*d*, and the parenchyma cells, which passed through the fourth sieve 30*d* and dropped on the fourth trough 15*d*, moved forward on the fourth trough 15*d* and dropped on the fourth container 37*d* from the front end of the fourth trough 15*d*.

With the above method, the bamboo was successfully separated into the bamboo fibers and the parenchyma cells with use of the sieving apparatus according to the present invention.

In addition, the bamboo fibers were successfully separated into large pieces and small pieces in accordance with the diameters, and the parenchyma cells were successfully separated into large pieces and small pieces in accordance with the particle diameters.

Meanwhile, although classification was performed with use of the two kinds of wedge wire screens having different opening widths S in the primary classification treatment, by using three or more kinds of wedge wire screens, the bamboo fibers can be separated in accordance with the diameters more finely, and the parenchyma cells can be separated in accordance with the particle diameters more finely.

Also, by using two or more kinds of porous plates having different hole diameters d in the secondary classification treatment, the bamboo fibers can be separated in accordance with the aspect ratios.

REFERENCE SIGNS LIST

1 Sieving apparatus
10*a* to 10*d* First classification device to fourth classification device
11*a* to 11*d* First inlet to fourth inlet
13*a* to 13*e* First vibration applying unit to fifth vibration applying unit
15*a* to 15*d* First trough to fourth trough
25*a* Upper cylindrical frame
25*b* Middle cylindrical frame
25*c* Lower cylindrical frame
28 Raw material inlet
30*a* to 30*d* First sieve to fourth sieve
31 Lid
36 Reprocessing container
37*a* to 37*d* First container to fourth container
42*a* Upper discharge portion
42*b* Middle discharge portion
42*c* Lower discharge portion
d1 Hole diameter of porous plate in third sieve
d2 Thickness of porous plate in third sieve
d3 Distance between adjacent holes of porous plate in third sieve
d4 Hole diameter of porous plate in fourth sieve
d5 Thickness of porous plate in fourth sieve
d6 Distance between adjacent holes of porous plate in fourth sieve
d7 Distance between plurality of porous plates in third sieve
d8 Distance between third sieve and third trough (or flat plate)
d9 Distance between third sieve and lid (flat plate)
S1, S2 First opening width, second opening width

The invention claimed is:

1. A sieving apparatus comprising:

a first sieving portion including a sieve with a plurality of elongated holes or slits; and a second sieving portion with a sieve constituted by a porous plate having round holes, the second sieving portion being employed after sieving by the first sieving portion, wherein the sieve included in the first sieving portion includes a first sieve and a second sieve arranged in a latter layer of the first sieve and having a shorter opening width in a shorter direction than an opening width in a shorter direction of an elongated hole or a slit of the first sieve, wherein the sieve included in the second sieving portion includes a third sieve having a longer hole diameter than the opening width in the shorter direction of the elongated hole or the slit of the first sieve and constituted by the porous plate having the round holes and a fourth sieve whose hole diameter is shorter than the opening width in the shorter direction of the elongated hole or the slit of the first sieve and longer than the opening width in the shorter direction of an elongated hole or a slit of the second sieve and constituted by the porous plate having the round holes, and wherein, among an object to be sieved, substances that have not passed through the second sieve are subjected to sieving with use of the third sieve, and substances that have passed through the second sieve are subjected to sieving with use of the fourth sieve.

2. A sieving method comprising:

an upstream process for sieving an object to be sieved based on difference in cross-sectional diameter with use of a first sieving portion including a sieve with a plurality of elongated holes or slits; and a downstream process for sieving the object that has passed through the elongated holes or slits in the upstream process based on difference in aspect ratio with use of a second sieving portion with a sieve constituted by a porous plate having round holes, wherein a diameter of the round holes in the porous plate constituting the sieve included in the second sieving portion is longer than an opening width in a shorter direction of the elongated hole or the slit of the sieve included in the first sieving portion, wherein the object is bamboo subjected to a superheated steam treatment and thereafter ground, wherein, in the upstream process, separation of the bamboo based on difference in cross-sectional diameter is performed, and wherein, in the downstream process, the bamboo is separated into a bamboo fiber and a parenchyma cell.

3. A sieving method comprising:

an upstream process of sieving an object to be sieved with use of a first sieving portion including a sieve with a plurality of elongated holes or slits; and a downstream process of sieving the object that has been subjected to the upstream process with use of a second sieving portion with a sieve constituted by a porous plate having round holes, wherein the sieve included in the first sieving portion includes a first sieve and a second sieve having a shorter opening width in a shorter direction than an opening width in a shorter direction of an elongated hole or a slit of the first sieve, wherein the sieve included in the second sieving portion includes a third sieve having an equal or longer hole diameter to or than the opening width in the shorter direction of the elongated hole or the slit of the first sieve and constituted by the porous plate having the round holes and a fourth sieve whose hole diameter is shorter than the opening width in the shorter direction of the elongated hole or the slit of the first sieve and longer than the opening width in the shorter direction of an elongated hole or a slit of the second sieve and constituted by the porous plate having the round holes, wherein the upstream process includes a first sieving process of the object with use of the first sieve and a second sieving process of the object that has passed through the first sieve with use of the second sieve, and wherein the downstream process includes a third sieving process for the object that has not passed through the second sieve with use of the third sieve and a fourth sieving process for the object that has passed through the second sieve with use of the fourth sieve.

4. The sieving method according to claim 3, wherein the object is bamboo subjected to a superheated steam treatment and thereafter ground, wherein, in the upstream process, separation of the bamboo based on difference in cross-sectional diameter is performed, and wherein, in the downstream process, the bamboo is separated into a bamboo fiber and a parenchyma cell.

5. The sieving apparatus according to claim 1, wherein each of the first sieve and the second sieve is constituted by a wedge wire screen.

6. The sieving apparatus according to claim 1, wherein each of the first sieve and the second sieve is constituted by a flat plate having oval holes.

7. The sieving apparatus according to claim 1, wherein each of the third sieve and the fourth sieve is constituted by a flat plate having a flat upper surface and having the round holes.

8. The sieving apparatus according to claim 7, wherein each of the third sieve and the fourth sieve has a longer dimension in thickness than a diameter of the round holes to interfere in substances each having a high aspect ratio, which pass through the round holes in the porous plate.

9. The sieving apparatus according to claim 7, wherein each of the third sieve and the fourth sieve is constituted by a plurality of porous plates.

10. The sieving apparatus according to claim 9, wherein a distance between the plurality of porous plates is equal to or shorter than the diameter of the round holes to interfere in substances each having a high aspect ratio, which pass through the round holes in the porous plate.

11. The sieving apparatus according to claim 7, wherein a flat plate is provided to be opposed to an upper surface of the sieve included in each of the third sieve and the fourth sieve or a lower surface of each of the third sieve and the fourth sieve.

* * * * *